US008115623B1

(12) United States Patent
Green

(10) Patent No.: US 8,115,623 B1
(45) Date of Patent: Feb. 14, 2012

(54) METHOD AND SYSTEM FOR HAND BASKET THEFT DETECTION

(76) Inventor: Robert M Green, Phoenix, AZ (US)

( * ) Notice: Subject to any disclaimer, the term of this patent is extended or adjusted under 35 U.S.C. 154(b) by 0 days.

(21) Appl. No.: 13/212,257

(22) Filed: Aug. 18, 2011

Related U.S. Application Data

(60) Provisional application No. 61/468,520, filed on Mar. 28, 2011.

(51) Int. Cl.
*G08B 1/08* (2006.01)

(52) U.S. Cl. ..... 340/539.13; 340/568.1; 340/572.1

(58) Field of Classification Search ..... 340/539.13, 340/533, 571, 572.1–572.9, 573.1, 522, 525, 340/539.1, 546, 568.1, 5.91
See application file for complete search history.

(56) References Cited

U.S. PATENT DOCUMENTS

| | | | | |
|---|---|---|---|---|
| 5,874,896 | A | 2/1999 | Lowe et al. | |
| 6,385,772 | B1 | 5/2002 | Courtney | |
| 6,464,269 | B1 * | 10/2002 | Wilhelm et al. | 292/307 R |
| 6,520,544 | B1 | 2/2003 | Mitchell et al. | |
| 6,608,563 | B2 | 8/2003 | Weston et al. | |
| 6,661,340 | B1 | 12/2003 | Saylor et al. | |
| 6,926,202 | B2 | 8/2005 | Noonan | |
| 6,998,987 | B2 | 2/2006 | Lin | |
| 7,005,988 | B2 | 2/2006 | Mathewson, II et al. | |
| 7,015,806 | B2 | 3/2006 | Naidoo | |
| 7,049,965 | B2 | 5/2006 | Kelliher et al. | |
| 7,123,146 | B1 | 10/2006 | Holzman | |
| 7,178,719 | B2 * | 2/2007 | Silverbrook et al. | 235/375 |
| 7,205,882 | B2 | 4/2007 | Libin | |
| 7,225,980 | B2 | 6/2007 | Ku et al. | |
| 7,242,300 | B1 | 7/2007 | Konstad et al. | |
| 7,304,574 | B2 | 12/2007 | Romer | |
| 7,518,506 | B2 | 4/2009 | Lee et al. | |
| 7,530,489 | B2 | 5/2009 | Stockton | |
| 7,531,007 | B2 | 5/2009 | Sharma | |
| 7,616,091 | B2 | 11/2009 | Libin | |
| 7,619,525 | B2 | 11/2009 | Kwan | |
| 7,667,604 | B2 * | 2/2010 | Ebert et al. | 340/572.4 |
| 7,671,729 | B2 | 3/2010 | Hershkovitz et al. | |
| 7,724,131 | B2 | 5/2010 | Chen | |
| 7,731,308 | B1 * | 6/2010 | Riemer | 312/209 |
| 7,761,347 | B2 | 7/2010 | Fujisawa et al. | |
| 7,796,037 | B2 | 9/2010 | Bauchot et al. | |
| 7,825,793 | B1 | 11/2010 | Spillman et al. | |

(Continued)

FOREIGN PATENT DOCUMENTS

CN 101256702 A 9/2008

(Continued)

OTHER PUBLICATIONS

Durban, Jack,"A Study of Available Technologies Addressing Asset Tracking and Localization", Vorelco, Nov. 23, 2008.

(Continued)

*Primary Examiner* — Daniel Previl

(57) ABSTRACT

A method for using electronic product identification devices to track the location and movement of plastic hand baskets in a food store or other retail store, to sound an audible alarm, to activate an alarm condition in a video surveillance system, alert store security, and send tag information (basket ID and contents thereof) and video clip to store security, and law enforcement if desired this method and system is designed to promote a major deterrence to theft of store items in a portable hand carried basket, and in the case of theft, to provide notification and video clip to security personnel and to any law enforcement office.

18 Claims, 5 Drawing Sheets

U.S. PATENT DOCUMENTS

| | | | | |
|---|---|---|---|---|
| 7,840,515 | B2 | 11/2010 | Ozdemir et al. | |
| 7,859,403 | B2 | 12/2010 | Tampke | |
| 7,889,068 | B2 | 2/2011 | Connell, II et al. | |
| 7,911,341 | B2 | 3/2011 | Raji et al. | |
| 7,920,062 | B1 | 4/2011 | Konstad et al. | |
| 2005/0017071 | A1* | 1/2005 | Noonan | 235/385 |
| 2005/0073416 | A1 | 4/2005 | Mathewson et al. | |
| 2006/0001537 | A1 | 1/2006 | Blake et al. | |
| 2006/0163350 | A1 | 7/2006 | Melton et al. | |
| 2006/0187042 | A1 | 8/2006 | Romer et al. | |
| 2006/0244588 | A1* | 11/2006 | Hannah et al. | 340/539.13 |
| 2007/0103303 | A1 | 5/2007 | Shoarinejad | |
| 2009/0045955 | A1 | 2/2009 | Ulrich | |
| 2009/0077167 | A1 | 3/2009 | Baum et al. | |
| 2009/0077624 | A1 | 3/2009 | Baum et al. | |
| 2009/0195388 | A1* | 8/2009 | Ikumi et al. | 340/572.1 |
| 2009/0237232 | A1 | 9/2009 | Connell, II et al. | |
| 2009/0261967 | A1 | 10/2009 | Chen | |
| 2009/0322537 | A1 | 12/2009 | Tapp et al. | |
| 2010/0019905 | A1 | 1/2010 | Boddie et al. | |
| 2010/0097221 | A1 | 4/2010 | Kreiner et al. | |
| 2010/0099461 | A1 | 4/2010 | Rahfaldt et al. | |
| 2010/0148966 | A1 | 6/2010 | Vuppala et al. | |
| 2010/0245582 | A1 | 9/2010 | Harel | |
| 2010/0251391 | A1 | 9/2010 | Adrangi | |
| 2010/0315508 | A1 | 12/2010 | Lee et al. | |
| 2011/0057787 | A1 | 3/2011 | Wu et al. | |
| 2011/0072132 | A1 | 3/2011 | Shafer et al. | |

FOREIGN PATENT DOCUMENTS

| | | | |
|---|---|---|---|
| DE | 102008041274 | A1 | 3/2009 |
| DE | 102009025202 | A1 | 12/2010 |
| EP | 1533768 | B1 | 10/2004 |
| EP | 1873705 | A1 | 1/2008 |
| GB | 2355876 | A | 5/2001 |
| GB | 2467440 | A | 8/2010 |
| JP | 2005-250902 | | 9/2005 |
| JP | 2006-338467 | | 12/2006 |
| JP | 2008-203974 | | 2/2007 |
| JP | 2007-158533 | | 6/2007 |
| JP | 2007-221191 | | 8/2007 |
| JP | 2008-015577 | | 1/2008 |
| JP | 2008-117102 | | 12/2008 |
| JP | 2008-294921 | | 12/2008 |
| JP | 2009-093520 | | 4/2009 |
| JP | 2009-157849 | | 7/2009 |
| JP | 2009-159648 | | 7/2009 |
| JP | 2009-181298 | | 8/2009 |
| JP | 2009-217374 | | 9/2009 |
| JP | 2010-055645 | | 3/2010 |
| JP | 2010-154134 | | 7/2010 |
| WO | WO/00/67221 | | 12/2000 |
| WO | WO/03/067538 | | 1/2003 |
| WO | WO/03/047258 | | 6/2003 |
| WO | WO/2006/020528 | | 4/2006 |
| WO | WO/2008/033954 | A2 | 3/2008 |
| WO | WO/2008/125621 | | 10/2008 |
| WO | WO/2008/157113 | | 12/2008 |
| WO | WO/2009/001408 | | 12/2008 |
| WO | WO/2009/081303 | | 7/2009 |
| WO | WO/2010/100583 | | 9/2010 |
| WO | WO/2011/028237 | | 3/2011 |

OTHER PUBLICATIONS

Broughton, Marissa,"Shoplifting is Costing Retailers Millions", Reprint, Protection Officer News, Fall 2001.

D'Onofrio, Tony, "Source Tagging: Security Tagging Goes Global", NZ Security Magazine, Apr./May 2011.

Swedberg, Claire,"Grocery Retailers Test RFID-Enabled Shopping Carts", RFID Journal, Oct. 11, 2006.

Wilkinson, Kelly,"Wheels of Fortune", Metro Silicon Valley's Weekly Newspaper, Jun. 3, 1999.

Bacheldor, Beth, "Transmission Company Puts RFID System Into Gear", RFID Journal, Aug. 14, 2006.

Marsh, Mike, "Is It Possible to Scan a Supermarket Trolley Using RFID?", Transponder News, May 13, 2005.

Unknown, "Shoplifting", Wikipedia, the Free Encyclopedia, May 2008.

Unknown, "Shopping Cart", Wikipedia, the Free Encyclopedia, Aug. 2007.

* cited by examiner

System Block Diagram

Hand Basket Monitoring System

GPS Tracking System

1. Basket removed from Store

Security System Host Software

METHOD AND SYSTEM FOR HAND BASKET THEFT DETECTION

CROSS-REFERENCE TO RELATED APPLICATIONS

Not applicable

Related References Cited

Related U.S. Patent Documents

| | | |
|---|---|---|
| 5,874,896 | Feb. 23, 1999 | Lowe; Peter R. , et al. |
| 6,385,772 | May 7, 2002 | Courtney; Jonathan D. |
| 6,520,544 | Feb. 18, 2003 | Mitchell; Nancy G. |
| 6,608,563 | Aug. 19, 2003 | Weston; Denise Chapman, et al |
| 6,661,340 | Dec. 9, 2003 | Saylor, Michael J., et al. |
| 6,926,202 | Aug. 9, 2005 | Noonan; William |
| 6,998,987 | Feb. 14, 2006 | Lin; Yun-Ting |
| 7,005,988 | Feb. 28, 2006 | Mathewson, II; James M., et al |
| 7,015,806 | Mar. 21, 2006 | Naidoo; Surendra N. |
| 7,049,965 | May 23, 2006 | Kelliher; Timothy Patrick |
| 7,123,146 | Oct. 17, 2006 | Holzman; Thomas G. |
| 7,205,882 | Apr. 17, 2007 | Libin, Phil |
| 7,225,980 | Jun. 5, 2007 | Ku; Chun-Hui; et al. |
| 7,242,300 | Jul. 10, 2007 | Konstad; Rolf A., et al. |
| 7,304,574 | Dec. 4, 2007 | Romer; Kevin, ct al. |
| 7,518,506 | Apr. 14, 2009 | Lee; Albert, et al. |
| 7,530,489 | May 12, 2009 | Stockton; Marcia L. |
| 7,531,007 | May 12, 2009 | Sharma; Bettadapura Srinath |
| 7,616,091 | Nov. 10, 2009 | Libin, Phil |
| 7,619,525 | Nov. 17, 2009 | Kwan; Derek |
| 7,671,729 | Mar. 10, 2010 | Hershkovitz; Shmuel, et al. |
| 7,724,131 | May 25, 2010 | Chen; Hong-Jyh |
| 7,761,347 | Jul. 20, 2010 | Fujisawa; Hiromichi, et al |
| 7,796,037 | Sep. 14, 2010 | Bauchot; Frederic, et al |
| 7,825,793 | Nov. 2, 2003 | Spillman; Vance P., et al. |
| 7,840,515 | Nov. 23, 2010 | Ozdemir; Hasan Timucin, et al |
| 7,859,403 | Dec. 28, 2010 | Tampke; Michael S. |
| 7,889,068 | Feb. 15, 2011 | Connell, II; Jonathan H., et al. |
| 7,911,341 | Mar. 22, 2011 | Raji; Reza, et al. |
| 7,920,062 | Apr. 5, 2011 | Konstad; Rolf A., et al. |
| 20050073416 | Apr. 7, 2005 | Mathewson, James M. II; et al. |
| 20060001537 | Aug. 11, 2005 | Salcedo, David M.; et al |
| 20060163350 | Jul. 27, 2006 | Melton; Michael N.; et al |
| 20060187042 | Aug. 24, 2006 | Romer; Kevin; et al. |
| 20070103303 | May 10, 2007 | Shoarinejad; Kambiz |
| 20090045955 | Feb. 19, 2009 | Ulrich; Richard |
| 20090077167 | Mar. 19, 2009 | Baum; Marc; et al. |
| 20090077624 | Mar. 19, 2009 | Baum; Marc; et al. |
| 20090237232 | Sep. 24, 2009 | Connell II; Jonathan H.; et al |
| 20090261967 | Oct. 22, 2009 | Chen; Hong-Jyh |
| 20090322537 | Dec. 31, 2009 | Tapp; Hollis M.; et al. |
| 20100019905 | Jan. 28, 2010 | Boddie; John Bennett; et al. |
| 20100097221 | Apr. 22, 2010 | Kreiner; Barrett; et al. |
| 20100099461 | Apr. 22, 2010 | Rahfaldt; James; et al |
| 20100148966 | Jun. 17, 2010 | Vuppala; Sunil Kumar; et al. |
| 20100245582 | Sep. 20, 2010 | Harel; Jean Claude |
| 20100251391 | Sep. 30, 2010 | Adrangi; Farid |
| 20100315508 | Dec. 16, 2010 | Lee; Hou-Hsien; et al. |
| 20110057787 | Mar. 10, 2011 | Wu; Chien-Huang; et al. |
| 20110072132 | Mar. 24, 2011 | Shafer; Gary Mark; et al. |

Related Foreign References Cited

European Patent Office (EPO Worldwide)

| | | |
|---|---|---|
| CN101256702 (A) | Sep. 3, 2008 | YANGDE LI [CN] |
| DE102008041274 (A1) | Mar. 26, 2009 | VISA PIX GMBH [DE] |
| DE102009025202 (A1) | Dec. 30, 2010 | EICHELE HERMANN [DE] |
| EP1873705 (A1) | Jan. 2, 2008 | CLEMENT |

-continued

| | | |
|---|---|---|
| GB2355876 (A) | May 2, 2001 | JEAN-YVES [FR]; et al EVANS, RICHARD [GB]; et al |
| GB2467440 (A) | Aug. 4, 2010 | ECKERT RAINER et al. |
| WO2008033954 A2) | Mar. 20, 2008 | HARWELL JANIS [US] |
| EP1533768 (B1) | Oct. 25, 2004 | Sacedo, David.; et al. |

Japan Patent Office (JPO) Patent and Utility Model

| | | |
|---|---|---|
| 2005-250902 | Sep. 15, 2005 | MATSUZAKI TAKASHI |
| 2006-338467 | Dec. 14, 2006 | USAMI RYOSUKE |
| 2007-158533 | Jun. 21, 2007 | HIKINO SHIN; et al |
| 2007-221191 | Aug. 30, 2007 | KUREYAMA FUMIKO; et al |
| 2008-015577 | Jan. 24, 2008 | YONETANI AKINORI; et al |
| 2008-117102 | May 22, 2008 | SAKURAI WATARU |
| 2008-203974 | Feb. 16, 2007 | TAKAHASHI KIYOYOSHI |
| 2008-294921 | Dec. 4, 2008 | TANIGAWA TOMOHIKO |
| 2009-093520 | Apr. 30, 2009 | AIZAWA KATSURA; et al |
| 2009-157849 | Jul. 16, 2009 | WATABE TETSUO |
| 2009-159648 | Jul. 16, 2009 | LAZO PHILIP A; et al |
| 2009-181298 | Aug. 13, 2009 | ENMEI TOSHIHARU |
| 2009-217374 | Sep. 24, 2009 | KOBAYASHI TAKESHI |
| 2010-055645 | Mar. 1, 2010 | FALUN DAVID B; et al |
| 2010-154134 | Jul. 8, 2010 | BABA KENJI; et al |

World Intellectual Property Organization (WIPO)

| | | |
|---|---|---|
| WO/2009/081303 | Jul. 2, 2009 | ALSAFADI, Yasser |
| WO/2000/067221 | Dec. 4, 2000 | GHAFFARI, Touraj; et al |
| WO/2008/125621 | Oct. 23, 2008 | FALKENBERG, Verner; et al |
| WO/2008/157113 | Dec. 24, 2008 | GILLARD, John, P; et al |
| WO/2006/020528 | Apr. 5, 2005 | Salcedo, David M; et al |
| WO/2009/001408 | Dec. 31, 2008 | OKAMASU TAKAYUKI; et al |
| WO/2003/047258 | Jun. 5, 2003 | JAKOPIN, David, A. et al. |
| WO/2003/067538 | Jan. 31, 2003 | CLIFFORD, Harold C., et al. |

Patentscope International and National Collections (Applications)

| | | |
|---|---|---|
| WO/2011/028237 | Mar. 10, 2011 | HO, Wing Kei; et al |
| WO/2010/100583 | Sep. 10, 2010 | GEVA, Rafi; et al |

Other References

Non Patent Literature

Durban, Jack, "A study of available technologies addressing Asset tracking and localization", Vorelco, Nov. 23, 2008

Broughton, Marissa, "Shoplifting is Costing Retailers Millions", Reprint Protection Officer News—Fall 2001

D'onofirio, Tony, "Source Tagging: Security Tagging Goes Global", NZ Security Magazine, April/May 2011

Swedberg, Claire, "Grocery Retailers Test RFID-enabled Shopping Carts" RFID Journal, Oct. 11, 2006

Unknown, "The Art of Shoplifting", Bombshock.com, unknown date

Wilkinson, Kelly, "Wheels Of Fortune", Metro, Silicon Valley's Weekly Newspaper, Jun. 3, 1999

Bacheldor, Beth, "Transmission Company Puts RFID System Into Gear", RFID Journal, Aug. 14, 2006

Marsh, Mike, ""Is it possible to scan a supermarket trolley using RFID?" Transponder News, May 13, 2005

Unknown, "Shoplifting", Wikipedia, The Free Encyclopedia, May, 2008

Unknown, "Shopping Cart", Wikipedia, The Free Encyclopedia, August 2007

STATEMENT REGARDING FEDERALLY SPONSORED RESEARCH OR DEVELOPMENT

Not Applicable

BACKGROUND OF THE INVENTION

1. Field of Invention

The present invention relates to a system for providing technology in plastic hand baskets or hand containers that can be detect a theft in progress when such hand baskets or hand containers are stolen. This invention uses RFID technology and integrates with camera and video surveillance systems to detect a theft in progress and trigger an alarm on the surveillance systems for immediate identification of theft.

2. Background of Invention

It has been proposed to place a RFID tag on or in a plastic hand basket or plastic hand container. Such plastic hand baskets or plastic hand containers are commonly used for shopping in grocery stores, pharmacies, or other similar stores, or any retail store, and such containers are commonly removed from the store illegally filled with stolen items.

The present disclosure embodies a number of aspects that can be implemented separately from or in combination with each other. An RFID tag can be placed on the plastic basket or container, or embedded in the plastic of such container or basket. An RFID reader can detect the RFID tag via short range frequency by placement of the RFID reader at store exits, thus providing a positive reading of the RFID tag as the plastic basket or container is leaving the store exit, indicating a theft is in progress. Using the RFID signal, the RFID reader will signal the camera surveillance system with an alarm that will activate the camera alarm system and alerting security that a theft has occurred.

In addition, another aspect of the invention is to place a GPS receiver in the plastic container or basket where a GPS location can be sent to law enforcement to track the stolen basket.

One principal target of this invention is grocery stores where thefts of baskets that are filled with other items are commonly stolen. This invention provides both deterrence to theft and an increased rate of identification and apprehension of perpetrators.

While the preferred embodiments of the invention have been described above, it will be recognized and understood that various modifications may be made therein and the appended claims are intended to cover all such modifications that may fall within the spirit and scope of the invention.

3. Definition of Terms

The following term definitions are provided to assist in conveying an understanding of the various exemplary embodiments and features disclosed herein.

GPS

The Global Positioning System (GPS) is a space-based global navigation satellite system (GNSS) that provides reliable location and time information in all weather and at all times and anywhere on or near the Earth when and where there is an unobstructed line of sight to four or more GPS satellites. It is maintained by the United States government and is freely accessible by anyone with a GPS receiver.

RFID

Radio-frequency identification (RFID) is a technology that uses communication via radio waves to exchange data between a reader and an electronic tag attached to an object, for the purpose of identification and tracking.

Fixed RFID: Reader reads tags in a stationary position. These fixed readers are set up specific interrogation zones and create a "bubble" of RF energy that can be tightly controlled if the physics is well engineered. This allows a very definitive reading area for when tags go in and out of the interrogation zone.

Mobile RFID: Reader is mobile when the reader reads tags. Mobile readers include handhelds, carts and vehicle mounted RFID readers.

3 types of RFID tags

Passive RFID tags: Have no power source and require an external electromagnetic field to initiate a signal transmission. Typically they get powered by the RF energy that the readers transmit. This type of tags typically store between 32 and 128 bits of data and are Read-Only.

Active RFID tags: Contain a battery and can transmit signals once an external source (interrogator') has be successfully identified. It can store up to 1 MB of data and are rewritable.

Battery assisted passive (BAP) RFID tags: Require an external source to wake up but have significant higher forward link capability providing greater range.

RFID Tags Range & Frequency

- Lower-frequency systems are less expensive: higher-frequency systems offer increased range.
- Low-Frequency (LF) 125 to 134 KHz band
- High-Frequency (HF) 13.56 MHz
- Ultra High-Frequency (UHF) 433 MHZ and 860 to 956 MHz band
- Microwave-Frequency 2.45 to 5.8 GHz band The range will depend on the type of frequencies used.

SMS

Short Message Service (SMS) is the text communication service component of phone, web, or mobile communication systems, using standardized communications protocols that allow the exchange of short text messages between fixed line or mobile phone devices

MMS

Multimedia Messaging Service, or MMS, is a standard way to send messages that include multimedia content to and from mobile phones. It extends the core SMS (Short Message Service) capability that allowed exchange of text messages only up to 160 characters in length.

PDA

A personal digital assistant (PDA), also known as a palmtop computer, or personal data assistant, is a mobile device that functions as a personal information manager. Current PDAs often have the ability to connect to the Internet. A PDA has an electronic visual display, enabling it to include a web browser, but some newer models also have audio capabilities, enabling them to be used as mobile phones portable media players. Many PDAs can access the Internet, intranets or extranets via Wi-Fi or Wireless Wide Area Networks.

Portable Computing Device

Mobile computing is a form of human-computer interaction by which a computer is expected to be transported during normal usage. Mobile computing has three aspects: mobile communication, mobile hardware, and mobile software. The first aspect addresses communication issues in ad-hoc and infrastructure networks as well as communication properties, protocols, data formats and concrete technologies. The second aspect is on the hardware, e.g., mobile devices or device components. The third aspect deals with the characteristics and requirements of mobile applications.

Many types of mobile computers have been introduced since the 1990s including the:

Wearable computer
Personal digital assistant/enterprise digital assistant
Smartphone
Carputer
Ultra-Mobile PC
Tablet computer

SNMP

Simple Network Management Protocol (SNMP) is an Internet-standard protocol for managing devices on IP networks. Devices that typically support SNMP include routers, switches, servers, workstations, printers, modem racks, and more. It is used mostly in network management systems to monitor network-attached devices for conditions that warrant administrative attention. SNMP is a component of the Internet Protocol Suite as defined by the Internet Engineering Task Force (IETF). It consists of a set of standards for network management, including an application layer protocol, a database schema, and a set of data objects.

URL

In computing, a Uniform Resource Locator (URL) is a Uniform Resource Identifier (URI) that specifies where an identified resource is available and the mechanism for retrieving it. In popular usage and in many technical documents and verbal discussions it is often incorrectly used as a synonym for URI.[1] The best-known example of the use of URLs is for the addresses of web pages on the World Wide Web, such as http://www.example.com/.

Smartphone

A smartphone is a mobile phone that offers more advanced computing ability and connectivity than a contemporary feature phone. Smartphones and feature phones may be thought of as handheld computers integrated with a mobile telephone, but while most feature phones are able to run applications based on platforms such as Java ME, a smartphone usually allows the user to install and run more advanced applications. Smartphones run complete operating system software providing a platform for application developers. Thus, they combine the functions of a camera phone and a personal digital assistant (PDA).

RTSP or Streaming Media

Streaming media is multimedia that is constantly received by and presented to an end-user while being delivered by a streaming provider.http://en.wikipedia.org/wiki/Streaming media-cite note-0 The name refers to the delivery method of the medium rather than to the medium itself. The distinction is usually applied to media that are distributed over telecommunications networks, as most other delivery systems are either inherently streaming (e.g., radio, television) or inherently non-streaming (e.g., books, video cassettes, audio CDs). The verb 'to stream' is also derived from this term, meaning to deliver media in this manner. Internet television is a commonly streamed medium.

Live streaming, more specifically, means taking the media and broadcasting it live over the Internet. The process involves a camera for the media, an encoder to digitize the content, a media publisher where the streams are made available to potential end-users and a content delivery network to distribute and deliver the content. The media can then be viewed by end-users live.

RSS (Most Commonly Expanded as Really Simple Syndication)

RSS is a family of web feed formats used to publish frequently updated works—such as blog entries, news headlines, audio, and video—in a standardized format. An RSS document (which is called a "feed", "web feed", or "channel") includes full or summarized text, plus metadata such as publishing dates and authorship. Web feeds benefit publishers by letting them syndicate content automatically. They benefit readers who want to subscribe to timely updates from favored websites or to aggregate feeds from many sites into one place. RSS feeds can be read using software called an "RSS reader", "feed reader", or "aggregator", which can be web-based, desktop-based, or mobile-device-based. A standardized XML file format allows the information to be published once and viewed by many different programs. The user subscribes to a feed by entering into the reader the feed's URI or by clicking a feed icon in a web browser that initiates the subscription process. The RSS reader checks the user's subscribed feeds regularly for new work, downloads any updates that it finds, and provides a user interface to monitor and read the feeds. RSS allows users to avoid manually inspecting all of the websites they are interested in, and instead subscribe to websites such that all new content is pushed onto their browsers when it becomes available.

IM (Instant Messaging)

Instant messaging (IM) is a form of real-time direct text-based communication between two or more people using personal computers or other devices, along with shared clients. The user's text is conveyed over a network, such as the Internet. More advanced instant messaging software clients also allow enhanced modes of communication, such as live voice or video calling.

SUMMARY OF THE INVENTION

The present invention is intended to provide deterrence for theft at grocery stores or any similar store where plastic hand baskets or plastic hand containers are offered to customers for shopping. A system that detects theft, activates the alarm conditions of a camera surveillance system, and monitors and tracks the location of stolen hand baskets or hand containers, will provide deterrence to crime, and in the case where there is a robbery, the system provides the capability for law enforcement to quickly identify the perpetrator, and to track the stolen basket or container and those who perpetuated the theft via the Global Positioning System (GPS).

One object of the present invention is to provide a method of detection of a theft in progress as the plastic hand basket or container is leaving the store exit, or unauthorized zone.

Another object of the present invention is to send a signal to an existing camera surveillance system to activate the alarm condition in such camera surveillance system and provide immediate alert information to store security and law enforcement.

Another object of the present invention is to use the GPS technology via an attached GPS receiver, to provide location information to law enforcement immediately after the occurrence of the detected theft.

Another object of the present invention is to report all of the items in the stolen plastic hand basket by reading the RFID tags on every item in the basket.

Another object of the present invention is to provide notification to store personnel that a theft has occurred so that it can be reported to law enforcement.

Another object of this invention is to activate an audible alarm signal as the stolen articles pass through the door exit to alert store personnel and provide deterrence to future thefts.

Another object of this invention is to optionally provide a monitor at the store exit which will list the items that have not been paid for along with live streaming video of the person leaving with the items with any message pre-programmed by the system administrator displayed on the monitor; the purpose of this option is also to provide deterrence to future thefts.

The RFID tag may be attached anywhere on the outside or inside of the basket, or by injection molding in the plastic basket/container during the manufacturing process, and in the case of being attached outside or inside the basket, may be covered with a an adhesive material such that the RFID tag is not seen.

BRIEF DESCRIPTION OF THE SEVERAL VIEWS OF THE DRAWINGS

The above and other objects, features, and advantages of the present invention are further described in the detailed description which follows, with reference to the drawings by way of non-limiting exemplary embodiments of the present invention, wherein like reference numerals represent similar parts of the present invention throughout the several views and wherein.

DETAILED DESCRIPTION OF THE INVENTION

Figure 1:
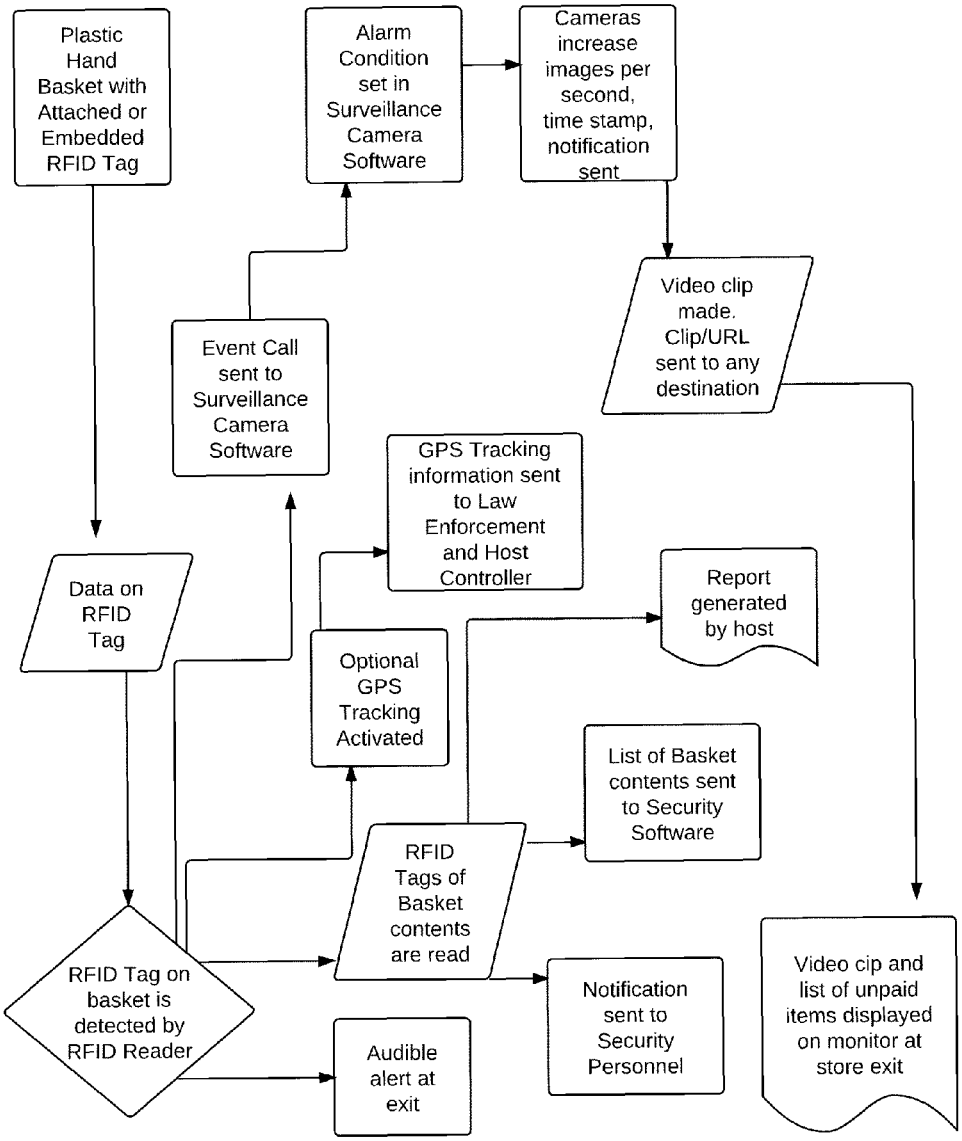
FIG. 1 is a block diagram showing the system process.
Figure 2:
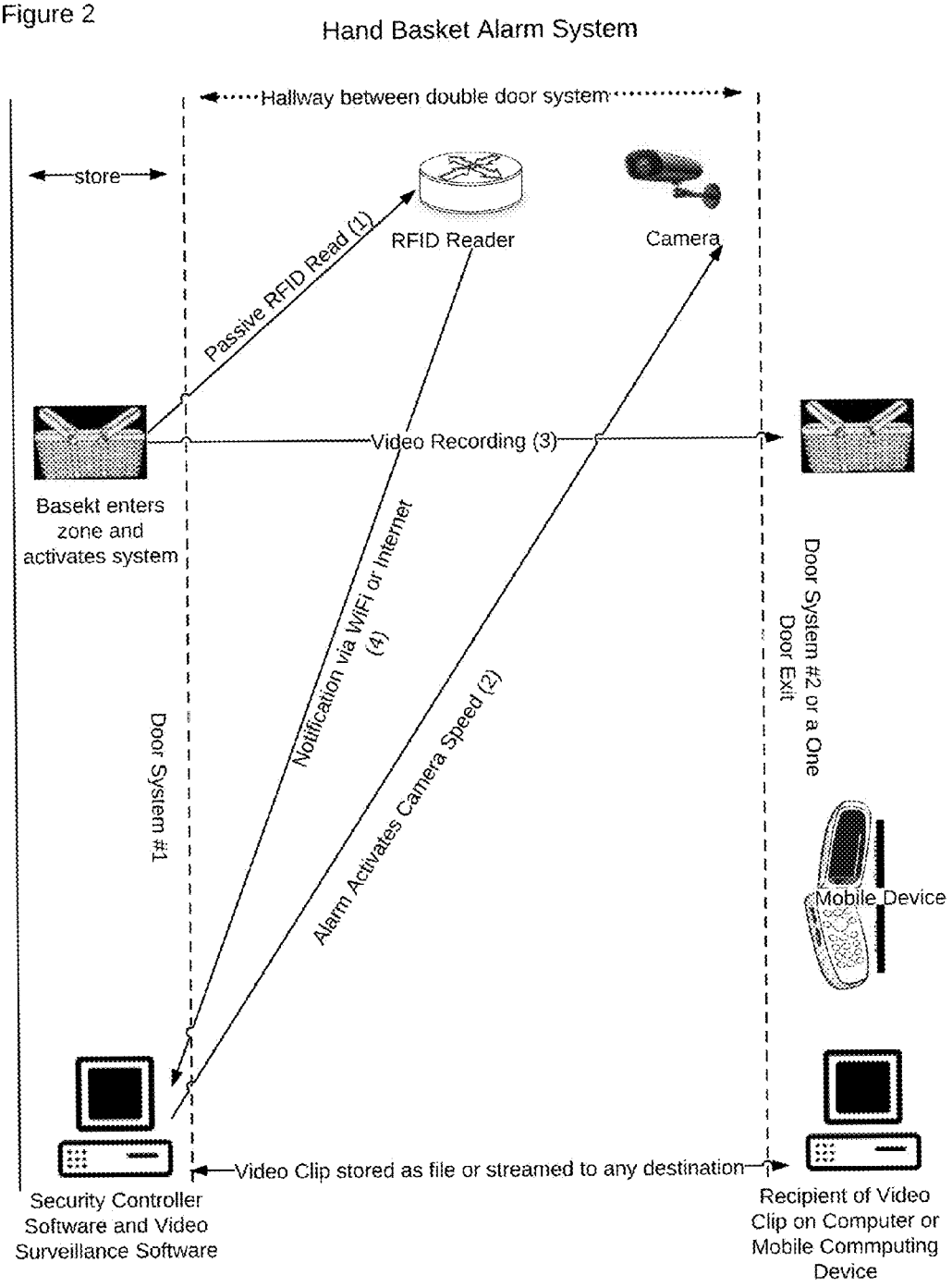
FIG. 2 is an overall view of the local store portion of the security and communications system from the plastic hand basket as it is detected leaving a store, the video surveillance system and creation of a video file, and notification of the alarm to any pre-determined location
Figure 3:
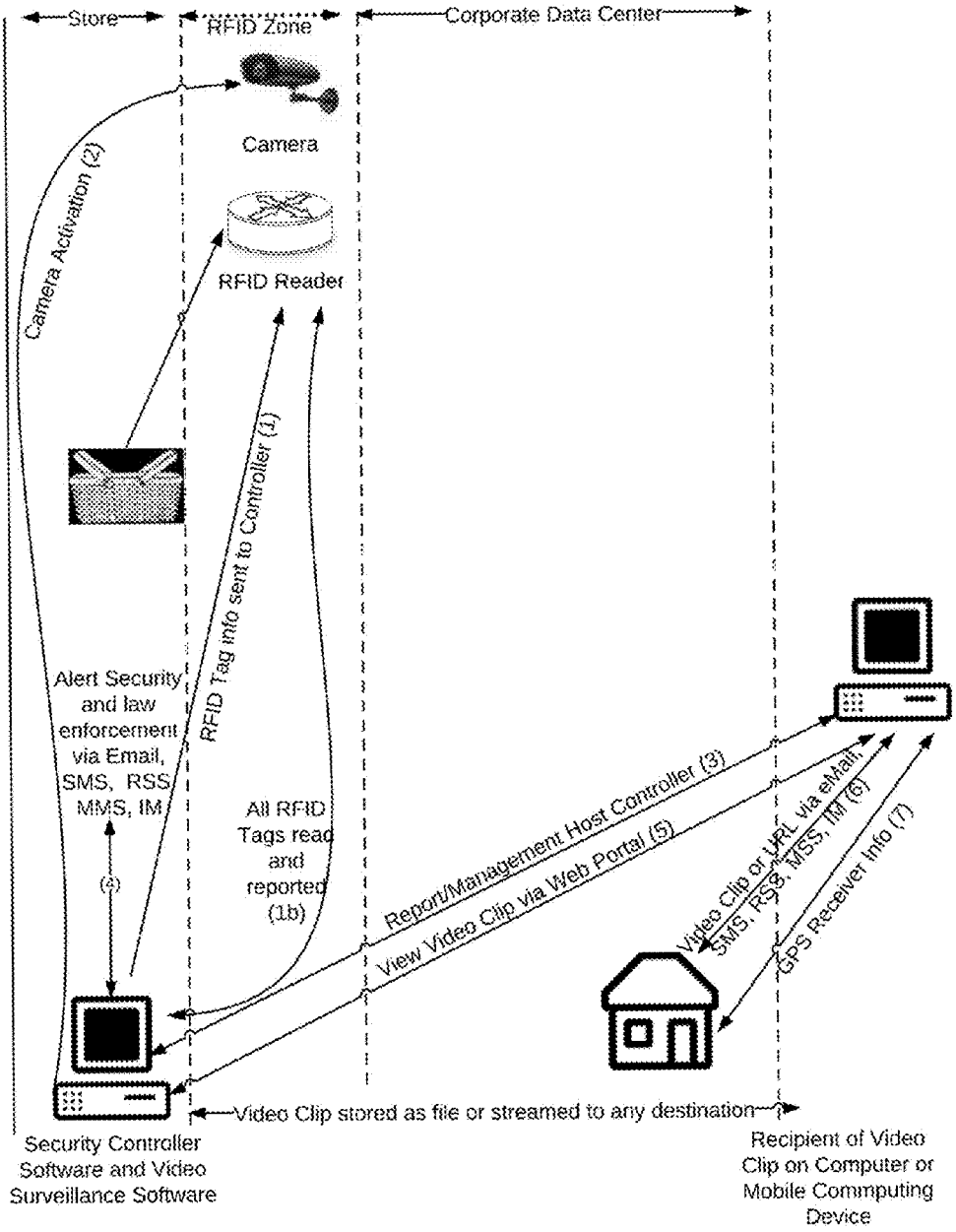
FIG. 3 is a diagram of the entire security and communications system including how one store is managed from a data center via SNMP, how an alarm is activated, and how alerts are issued.
Figure 4:
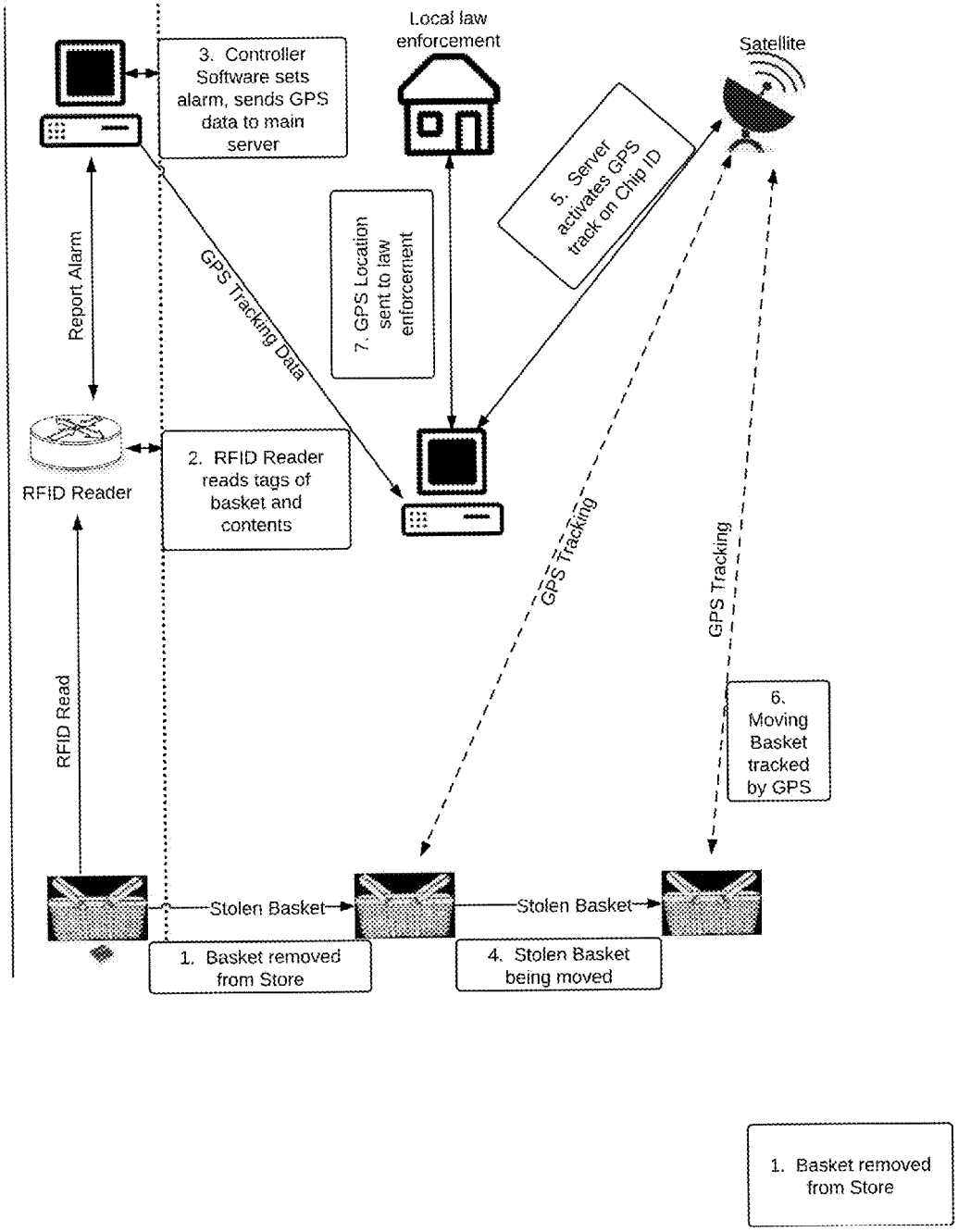
FIG. 4 is a diagram overview of the GPS tracking system in the case where a GPS receiver is used to aid law enforcement in tracking stolen baskets/containers.
Figure 5:
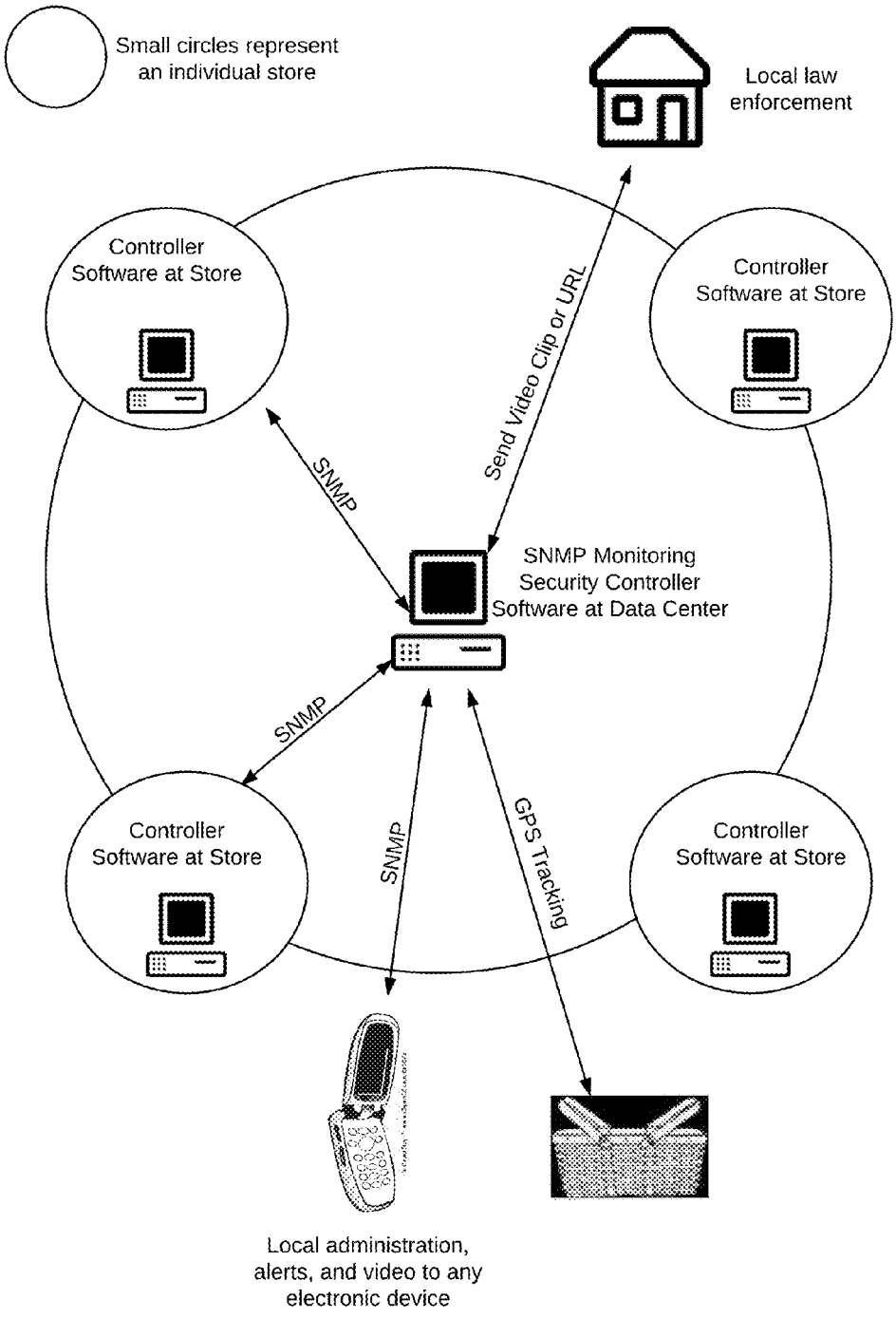
FIG. 5 is a diagram overview of the entire security network and how a central server manages each remote store or location via SNMP open standards.

Plastic hand baskets are typically used at stores for shopping. This invention will have a passive RFID or NFC (Near Field Communications) tag affixed to the basket (container) at the store or at the manufacturer, or manufactured with a passive RFID UHF chip or NFC chip inserted into the container during the injection molding process (U.S. Pat. No. 7,875,227, Chisolm), and/or a GPS receiver chip. This is dependent on the request of the chain store company and the compliance of the container manufacturer. Technology and patents already exist to do this, and this application simply needs to use containers with specified tags or chips.

Although the detailed description herein contains many specifics for the purposes of illustration, anyone of ordinary skill in the art will appreciate that many variations and alterations to the following details are within the scope of the embodiments described herein. Thus, the following illustrative embodiments are set forth without any loss of generality to, and without imposing limitations upon, the claimed invention.

A fixed RFID reader is placed at the exit doors of a store, and is programmed to read the RFID tag at an approximate distance of 5 feet, however, this distance is programmable by the controller software.

Since the plastic hand baskets should not be removed from a store, a positive RFID tag reading is presumed to be a theft, which will later be confirmed via surveillance video. A positive tag reading of the plastic hand basket is sent from the fixed RFID reader to the controller software via LAN connection or wireless. The controller software then sends an event notification to the surveillance video software which sets an alarm condition. The alarm condition in the surveillance video software increases the shutter speed of the cameras located at the doors to collect higher definition images. The video surveillance software will keep this alarm condition for a set amount of time which is programmable by the controller software, will time stamp the alarm condition, and will send a notification to the controller software, which will send a notification of theft to one or more of several destinations: host controller software run at a corporate data center or run at a hosting security company, local security personnel via, SMS, MMS, RSS, IM, paging, pre-recorded voice call, or any other preferred method of notification, or by activating a screen splash or pop up with audible alert on any smartphone, mobile, cellular, PDA, or any portable device or portable computing device. The host controller file will extract the digital image data and write a file to disk; the file can be a video clip file in any format, or a digital still image. In addition, the video clip file will be created which will begin at a pre-programmed time before the alarm is set, and continue for a pre-programmed time after the alarm is set; the video clip file or a URL of a link to a web site to view the video clip file will be sent via IP or any electronic means to the host security software, and to local security personnel via SMS, MMS, IM, paging, pre-recorded voice call, or by activating a splash screen or pop up on a mobile device or portable computing device.

Immediately after the RFID tag read of the hand plastic basket, the fixed RFID reader will also read the contents of such basket via short range read, as the basket passes by the fixed reader. This tag information is sent via wireless or wired to the controller software, which will include this information with the message notification.

It is recommended in this system that the user of this invention either use existing surveillance cameras or install additional surveillance cameras such that said cameras will continue to record digital images of the store exit and surrounding area in order to aid law enforcement with additional evidence such as automobile identification of the person who perpetrated the theft.

Another aspect of this invention is to activate an audible alarm signal as the stolen articles pass through the door exit to alert store personnel and provide deterrence to future thefts. The length and type of signal will be set by programmable option in the controller software.

Another aspect of this invention is to provide a monitor at the store exit which will list the items that have not been paid for along with live streaming video of the person leaving with the items with an optional message pre-programmed by the system administrator in the security controller software which will be displayed on the monitor; the purpose of this option is also to provide deterrence to future thefts.

Another additional aspect is the use of a GPS receiver affixed to the basket or inserted by injection molding during the manufacturing process (patent pending by author of this invention). In this case, the GPS receiver information is previously known to the controller software, and is sent to any pre-programmed location, including but not limited to the host controller software at run at the corporate data center or hosted by a security company, where such location has a GPS tracker to monitor the location of the GPS receiver, and hence, the plastic hand basket and its' contents that were stolen. The GPS information may also be transmitted to pre-determined law enforcement offices via any electronic means, such as, SMS, RSS, MSS, IM, paging, pre-recorded voice call, splash screen or pop up in a mobile device, or any other preferred method of notification, for use by law enforcement to track the items and perpetrator.

A recorded video clip file, or still images, or a URL to link to a web site to view the video clip file or still images, and RFID tag information of items stolen and notification of the theft will be sent via electronic means to any pre-determined law enforcement office or store security personnel.

Another aspect is to transmit live video as it is recording via video streaming technology such as RTSP, or a URL to link to a web site to view the live streaming video by electronic means, including but not limited to, SMS, MMS, RSS, IM, or email, to store security personnel, security controller software run at corporate data center or hosted by security company, or to pre-determined law enforcement offices.

The system shall have an inventory mode in which a stack of baskets may be placed within range of the RFID reader so the system will perform an inventory count of the baskets, and to further report to store security personnel a summary of the inventory including notification if there are missing baskets. Store personnel can use a GUT in the software controller to add baskets to the inventory.

A security controller application is run at a data center that manages each store location, and send and receive data to any store location, and uses the SNMP open standard for managing devices on an IP network. The systems administrator at the data center have ultimate control of each installed system and will set user rights and notifications of each store, and determine if anyone at a specific store shall have systems administrator rights into the security system. Administration functions include viewing video clips created by alarm conditions, configuration of all variable settings and options at each store, and adding baskets to the inventory at any store. A master database will store the number of baskets at each store.

The security system may use an application on a mobile, cellular, PDA, or any portable device or portable computing device that allows the authorized user access to the controller software to view status, set alert, view any camera, change direction of camera, and run a system test to verify all pieces of the system are working properly, and to activate audio recording to record any activity that may be needed to have recorded.

What is claimed is:

1. A wired or wireless security system that monitors the removal of plastic hand baskets (plastic hand containers) from a store environment, where the system monitors the baskets within a store using RFID tag information, where the system detects the removal of each registered plastic hand basket when taken outside of the store area indicating a theft occurred, where the components of the hand basket theft detection security system comprise: A plastic hand basket with a passive RFID tag affixed on the inside or outside anywhere on the basket, or inserted into the plastic via injection molding during the manufacturing process, a fixed or mobile RFID reader, and RFID or Near Field Communications antennas enabled with wired or wireless (Wi-Fi) communications that provides registration RFID tag information to the local or hosted security software application, a camera surveillance system activated by the security controller software, wherein the security controller software transmits notification to pre-determined security personnel, main controller software at corporate data center or hosted security company via an electronic means comprising SMS, MMS, RSS, pre-recorded voice call, or screen splash or pop up on a portable electronic computing device application, and where the system transmits the RFID tag information from the basket and all of the RFID tags read of contents in the basket via electronic means to pre-determined security personnel, main controller software at corporate data center or hosted security company via electronic means, and where a video clip of the event beginning prior to the RFID reading and continuing to a pre-set time after the reading, sent to security personnel, main controller software at corporate data center or hosted security company via electronic means.

2. The security system as in claim 1 wherein the system configures the RFID reader mounted or placed in the near proximity of the store door exit enabled to do short range RFID reading via pre-programmed desired distance from reader.

3. The security system as in claim 1 wherein the RFID reader transmits the tag information of the plastic hand basket via wired or wireless network to a security software application, and further, wherein the RFID reader transmits the tag information from all contents read in the plastic hand basket via wired or wireless network to a security software application.

4. The security system as in claim 1 wherein the security software application causes the camera surveillance system to go into an alarm condition, sets a time stamp and camera speed increased to higher resolution imaging, and where the system configures any number of available cameras an alarm condition.

5. The security system as in claim 1 wherein the system transmits notification of presumed theft to store security personnel via an electronic means comprising SMS, MSS, RSS, IM, paging, pre-recorded voice call, or splash screen or pop up in a mobile device.

6. The security system as in claim 1 wherein the system transmits RFID tag information and notification of presumed theft via the internet (IP) to the main security controller software at the corporate data center or hosted by a security company.

7. The security system as in claim 1 wherein the system transmits RFID tag information and notification of presumed theft via the internet (IP) to any pre-determined local law enforcement office via any electronic means comprising SMS, MMS, RSS, IM, pre-recorded voice call, or splash screen or pop up in a mobile device.

8. The security system as in claim 1 wherein the system creates a video clip file coupled to the camera surveillance system beginning a pre-programmed length of time prior to the RFID reading of the plastic hand basket and continuing to a pre-programmed length of time after the RFID reading.

9. The security system as in claim 1 wherein the system transmits a video clip file, or a URL to link to a web site to view the video file via electronic means, or sent via video streaming technology comprising SMS, MMS, RSS, IM, or email to store security personnel, security controller software run at corporate data center or hosted by security company, or to pre-determined law enforcement offices.

10. The security system as in claim 1 wherein the system configures the host controller software application can is configured to send and receive data to any number of store security software controllers.

11. The security system as in claim 1 wherein the system configures security controller software application to activate an event and alarm in any existing camera surveillance system using any camera, or any number of available cameras, or photographic technology comprising still images, streaming video, CCTV, and extract any desired data to digitally record and write a file to a disk.

12. The security system as in claim 1 where the software controller configures an inventory mode wherein a stack of plastic hand baskets placed within range of the fixed RFID reader to provide an inventory count of hand baskets and report any baskets missing, and allow a system administrator to add baskets to the inventory through a graphical user interface (GUI) of the security software controller.

13. The security system as in claim 1 wherein the security software application extracts one or more digital image pictures and sends to one or more portable electronic computing devices via an electronic means comprising MMS, RSS, IM, and sends via electronic means to one or more other destinations.

14. The security system as in claim 1 wherein the security software application transmits the video clip file, or a URL to link to a web site to view the video file, to one or more portable electronic computing devices via electronic means comprising MMS, RSS, IM, to pre-determined store personnel comprising video streaming technology.

15. The security system as in claim 1 wherein the security software application transmits the video file to one or more portable electronic computing devices comprising RTSP or any other protocol method of streaming video.

16. The security system as in claim 1 wherein the security software application activates an audible signal located at the proximate area of the store exit where the duration, volume, and type of signal is configured to be programmed in the security software controller.

17. The security system as in claim 1 wherein a display monitor placed at the proximate area of the store exit displays live streaming video of the person leaving with the basket with an optional message pre-programmed by the system administrator in the security controller software which will be displayed on the monitor; the purpose of this option deters future thefts.

18. The security system as in claim 1 wherein an application, or applet, used on a portable electronic computing device allows the authorized user access to the controller software to view status, set alert, view any camera, change direction of camera, and run a system test to verify the status and functionality of all pieces of the system, and to activate audio recording to record any activity that may be needed to have recorded.

* * * * *